US010823198B2

(12) United States Patent
Sishtla et al.

(10) Patent No.: US 10,823,198 B2
(45) Date of Patent: Nov. 3, 2020

(54) DIFFUSER FOR A CENTRIFUGAL COMPRESSOR AND CENTRIFUGAL COMPRESSOR HAVING THE SAME

(71) Applicant: Carrier Corporation, Jupiter, FL (US)

(72) Inventors: Vishnu M. Sishtla, Manlius, NY (US); Kai Deng, Shanghai (CN); Zhanbo Du, Shanghai (CN); Xili Liu, Shanghai (CN); Scott A. Nieforth, Syracuse, NY (US); Biao Shu, Shanghai (CN); Danni Yuan, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/343,958

(22) PCT Filed: Oct. 23, 2017

(86) PCT No.: PCT/US2017/057849
§ 371 (c)(1),
(2) Date: Apr. 22, 2019

(87) PCT Pub. No.: WO2018/080983
PCT Pub. Date: May 3, 2018

(65) Prior Publication Data

US 2019/0249687 A1 Aug. 15, 2019

(30) Foreign Application Priority Data

Oct. 24, 2016 (CN) ..... 2016 1 0924490

(51) Int. Cl.
*F04D 29/46* (2006.01)
*F04D 27/02* (2006.01)

(52) U.S. Cl.
CPC ..... *F04D 29/462* (2013.01); *F04D 27/02* (2013.01); *F04D 27/0253* (2013.01); *F04D 29/464* (2013.01); *F05B 2240/123* (2013.01)

(58) Field of Classification Search
None
See application file for complete search history.

(56) References Cited

U.S. PATENT DOCUMENTS 2,940,338 A * 6/1960 Wood ..... F02B 33/00 475/107
3,250,221 A * 5/1966 Williams ..... F04D 29/047 415/112

(Continued)

FOREIGN PATENT DOCUMENTS

CN 1171020 C 10/2004
CN 1821552 A 8/2006

(Continued)

OTHER PUBLICATIONS

International Search Report and Written Opinion for application PCT/US2017/057849, dated Jan. 25, 2018, 12 pages.

(Continued)

*Primary Examiner* — Michael Lebentritt
(74) *Attorney, Agent, or Firm* — Cantor Colburn LLP

(57) ABSTRACT

A diffuser for a centrifugal compressor and a centrifugal compressor having the same. The diffuser (100) comprises a drive component (110), a transmission assembly (120), an adjustment assembly (130), a spool valve assembly (140) and a rear wall (150); wherein the transmission assembly is used for transmitting power produced by the drive component to the adjustment assembly, the adjustment assembly is capable of circumferentially reciprocating with respect to the rear wall and driving the spool valve assembly to reciprocate axially; and wherein a rolling element (160) is provided between the adjustment assembly and the rear (Continued)

wall. Intervention of a mechanism for adjusting a flow passage width is better achieved by such an arrangement in combination with an existing configuration of the diffuser; and a low-friction fit between the adjustment assembly and the rear wall is achieved by the rolling element.

14 Claims, 4 Drawing Sheets

(56) References Cited

U.S. PATENT DOCUMENTS 3,490,746 A * 1/1970 Bell ..... F02C 7/18 415/177
3,868,196 A * 2/1975 Lown ..... F04D 27/0215 415/146
4,403,913 A 9/1983 Fisker
4,718,819 A * 1/1988 Rogo ..... F04D 29/462 415/149.1
4,744,678 A * 5/1988 Fickelscher ..... F16C 35/073 384/461
4,825,645 A * 5/1989 Bell ..... F02C 3/10 60/791
5,116,197 A 5/1992 Snell
5,207,559 A 5/1993 Clevenger et al.
5,237,811 A * 8/1993 Stockwell ..... F02C 5/12 60/39.39
5,237,817 A * 8/1993 Bornemisza ..... F01D 25/16 415/196
5,807,071 A 9/1998 Brasz et al.
6,129,511 A 10/2000 Salvage et al.
6,506,011 B1 1/2003 Sishtla
6,872,050 B2 3/2005 Nenstiel
7,520,716 B2 4/2009 Tacconelli et al.
7,824,148 B2 11/2010 Tetu et al.
8,079,808 B2 12/2011 Sconfietti
8,240,984 B2 8/2012 Noelle
8,632,302 B2 1/2014 Sorokes et al.
9,434,238 B2 * 9/2016 Kober ..... B60H 1/3435
2009/0004032 A1 * 1/2009 Kaupert ..... F01D 15/005 417/365
2009/0133431 A1 * 5/2009 Nakazeki ..... F16C 39/06 62/402
2010/0284796 A1 * 11/2010 Mitsuda ..... F04D 7/02 415/173.1
2011/0044810 A1 * 2/2011 Ions ..... F16D 1/068 415/229
2012/0017603 A1 * 1/2012 Bart ..... F02C 7/06 60/792
2012/0263586 A1 * 10/2012 Patil ..... F04D 27/0246 415/208.1
2013/0062886 A1 * 3/2013 Fujiwara ..... H02K 7/08 290/1 C
2013/0182987 A1 * 7/2013 Himeno ..... B29C 70/16 384/523
2014/0226929 A1 * 8/2014 Katsuno ..... F16C 33/418 384/531
2014/0328667 A1 11/2014 Nenstiel et al.
2015/0086341 A1 3/2015 Heidingsfelder et al.
2015/0285304 A1 * 10/2015 Geiger ..... F16C 33/36 384/527
2015/0322965 A1 * 11/2015 Hasegawa ..... F04D 17/122 415/150
2016/0040730 A1 * 2/2016 Fujiwara ..... F03D 15/10 29/888
2016/0208808 A1 7/2016 Jiang et al.
2016/0208854 A1 * 7/2016 Miwa ..... F16C 33/32
2017/0204906 A1 * 7/2017 Koganei ..... F16C 33/586
2018/0058452 A1 * 3/2018 Yuki ..... F04C 18/16
2018/0231113 A1 * 8/2018 Schulz ..... F16H 1/28
2018/0245628 A1 * 8/2018 Takaoka ..... F16F 15/0237

FOREIGN PATENT DOCUMENTS

CN 201159212 Y 12/2008
CN 201696311 U 1/2011
CN 202266509 U 6/2012
CN 102619787 A 8/2012
CN 103075370 A 5/2013
CN 203730350 U 7/2014
CN 104131999 A 11/2014
CN 204061335 U 12/2014
CN 204239338 U 4/2015
CN 105526194 A 4/2016
CN 205371092 U 7/2016
EP 3040562 A1 7/2016
TW I544151 B 8/2016
WO 2015170106 A1 11/2015

OTHER PUBLICATIONS

Chinese Office Action for application CN 201610924490.3, dated May 22, 2020, 10 pages.

* cited by examiner

DIFFUSER FOR A CENTRIFUGAL COMPRESSOR AND CENTRIFUGAL COMPRESSOR HAVING THE SAME

FIELD OF THE INVENTION

The present invention relates to the field of refrigeration devices, and more particularly to a diffuser for a centrifugal compressor.

BACKGROUND

In the field of refrigeration, a compressor is a particularly critical part in a refrigeration system. A good compressor can provide a more excellent refrigeration performance. As one type of refrigeration compressors, centrifugal compressors are widely used in the field of commercial refrigeration due to their capacities of providing efficient and large tonnage of refrigeration. However, under different operating conditions, especially under a condition of partial load operation, problems such as compressor surge and vibration and the like easily occur at a constant diffuser flow passage of a centrifugal compressor. In this context, various structural designs are often adopted to enable an adjustable flow passage width of the compressor diffuser, to thereby improve the surge problem of the centrifugal compressor and to reduce compressor noise and vibration. As one of the embodiments, a spool valve assembly can be provided on the diffuser to achieve the effect of adjusting the flow passage width of the diffuser. However, how to reasonably arrange the spool valve assembly in the diffuser and how to adjust and improve relevant structures have become urgent technical problems to be solved.

SUMMARY OF THE INVENTION

An object of the present invention is to provide a diffuser for a centrifugal compressor, which is capable of adjusting a flow area of a diffuser flow passage.

A further object of the present invention is to provide a centrifugal compressor which is capable of adjusting a flow area of a diffuser flow passage.

According to one aspect of the present invention, there is provided a diffuser for a centrifugal compressor, comprising: a drive component, a transmission assembly, an adjustment assembly, a spool valve assembly and a rear wall; wherein the transmission assembly is used for transmitting power produced by the drive component to the adjustment assembly, the adjustment assembly is capable of reciprocating circumferentially with respect to the rear wall and driving the spool valve assembly to reciprocate axially; and wherein a rolling element is provided between the adjustment assembly and the rear wall.

According to another aspect of the present invention, there is further provided a centrifugal compressor comprising the diffuser as described above.

DETAILED DESCRIPTION OF EMBODIMENTS

Figure 1:
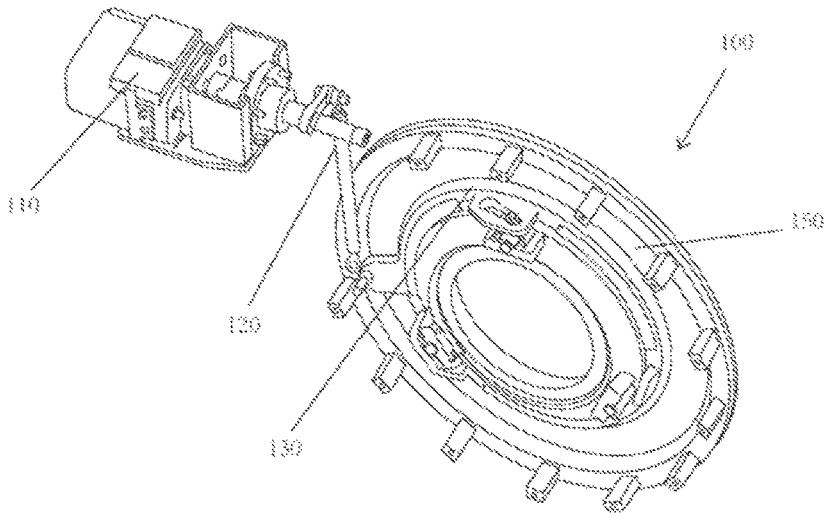
FIG. 1 is a stereoscopic view of one embodiment of a diffuser for a centrifugal compressor according to the present invention.
Figure 2:
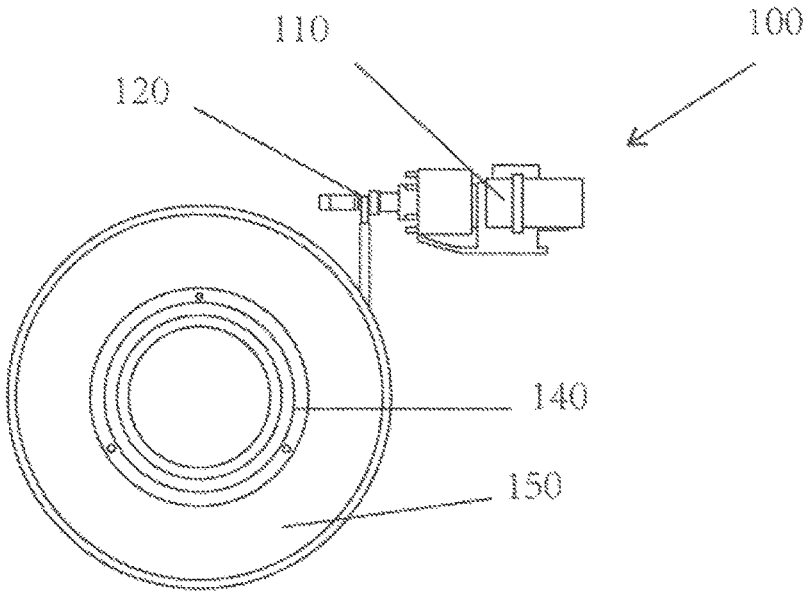
FIG. 2 is a front view of one embodiment of a diffuser for a centrifugal compressor according to the present invention.

With reference to FIG. 1 and FIG. 2, there is shown an embodiment of a diffuser 100 for a centrifugal compressor. The diffuser 100 comprises a drive component 110, a transmission assembly 120, an adjustment assembly 130, a spool valve assembly 140 and a rear wall 150. The transmission assembly 120 is used for transmitting power produced by the drive component 110 to the adjustment assembly 130, and the adjustment assembly 130 is capable of reciprocating circumferentially with respect to the rear wall 150 and driving the spool valve assembly 140 to reciprocate axially; wherein a ball bearing 160 (shown in FIG. 4) is provided between the adjustment assembly 130 and the rear wall 150. Intervention of a mechanism for adjusting a flow passage width is better achieved by such an arrangement in combination with an existing configuration of the diffuser; and a low-friction fit between the adjustment assembly 130 and the rear wall 150 is achieved by the ball bearing 160, such that the ball bearing 160 can better assume functions of intermediate transmission and diversion of a torque and continuously transmit the torque produced by the drive component 110 to the spool valve assembly 140 with low power consumption, thereby achieving an stepless adjustment for the diffuser flow passage width, efficiently improving shut-down reverse rotation or surge problems of the compressor and reducing exhaust pressure pulsation and vibration noise. According to the teaching of embodiment, other rolling elements that reduce a friction fit similar to the ball bearing 160 are also applicable herein.

Constituent Details of various assemblies will be illustrated respectively in detail below in conjunction with FIG. 3 to FIG. 7.

Figure 3:
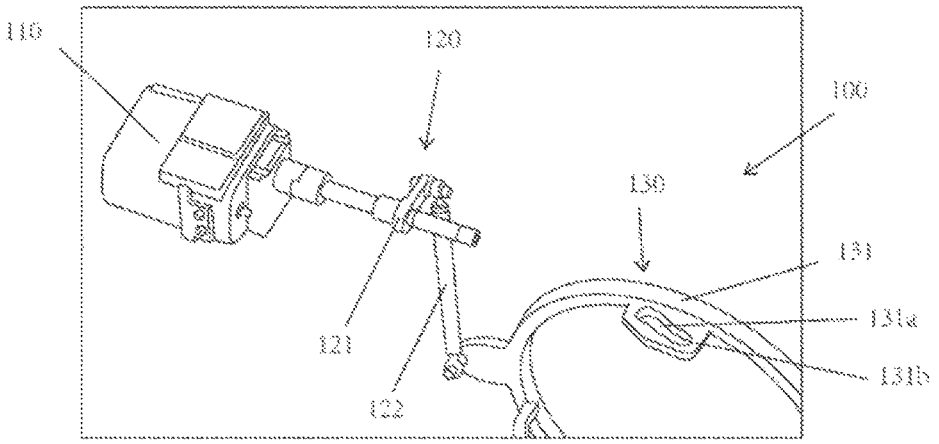
FIG. 3 is a schematic view of configurations of a drive component, a transmission assembly and an adjustment ring in one embodiment of a diffuser for a centrifugal compressor according to the present invention.

With reference to FIG. 3, there is shown a schematic view of configurations of the drive component 110, the transmission assembly 120 and a part of the adjustment assembly 130 in one embodiment of the diffuser for the centrifugal compressor according to the present invention. The drive component 110 is a motor for outputting a torque. The transmission assembly 120 comprises a crank 121 and a connecting rod 122. One end of the crank 121 is connected to an output shaft of the drive component 110 and the other end of the crank 121 is connected to the connecting rod 122. One end of the connecting rod 122 is connected with the crank 121 and the other end of the connecting rod 122 is connected to the adjustment assembly 130. During operation, the drive assembly 120 outputs the torque and drives the crank 121 connected therewith to rotate. Rotary motion of the crank 121 is converted into linear reciprocating motion via the connecting rod 122, and the linear reciprocating motion of the crank 121 is further converted into circumferential reciprocating motion of the adjustment assembly 130 with respect to the rear wall. In this figure, a part of the adjustment assembly 130, i.e., an adjustment ring 131, is shown. An axially protruding boss 131*b* is provided on the adjustment ring 131 and a diagonal groove 131*a* for providing a motion diverting function is provided on the boss 131*b*, so as to continuously transmit the motion. In such an arrangement, under the driving of the drive component 110, the adjustment ring 131 is subjected to circumferential reciprocating rotary motion with respect to the rear wall through the driving of the transmission assembly 120, and further transmits the motion to the spool valve assembly not shown in the figure.

Figure 4:
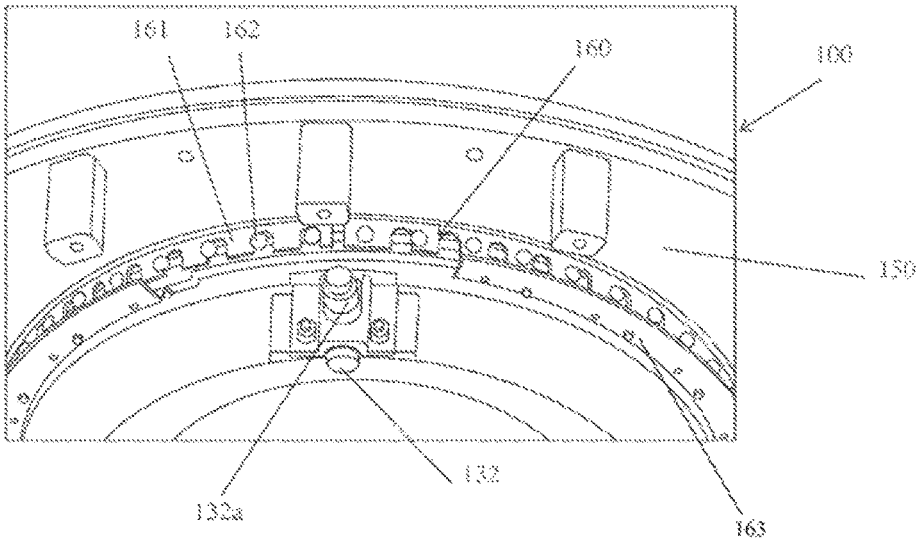
FIG. 4 is a schematic view of configurations of a ball bearing and a guiding rod in one embodiment of a diffuser for a centrifugal compressor according to the present invention.

With reference to FIG. 4, there is shown a schematic view of configurations of the ball bearing 160 and a part of the adjustment assembly 130 in one embodiment of the diffuser for the centrifugal compressor according to the present invention. The ball bearing 160 comprises: a ball cage 161 with openings provided circumferentially; balls 162 arranged in the openings; and a baffle 163 for limiting axial movement of the ball cage; wherein the baffle 163 is fixed on the rear wall 150 and the ball cage 161 is arranged circumferentially between an inner side of the adjustment assembly 130 and an outer side of the rear wall 150, such that the rotary reciprocating motion of the adjustment assembly 130 with respect to the rear wall 150 can be effectively improved, so as to reduce the friction loss in the process of motion transmission. Moreover, in this figure, only another part of the adjustment assembly 130, i.e., a guiding rod 132, is shown. A positioning pin 132*a* protruding circumferentially and outwardly is provided on the guiding rod 132 so as to insert into the diagonal groove 131*a* of the adjustment ring 131, thereby realizing cooperation between the guiding rod 132 and the adjustment ring 131. Such a cooperation mode and a motion relationship will be explained in detail below.

Figure 5:
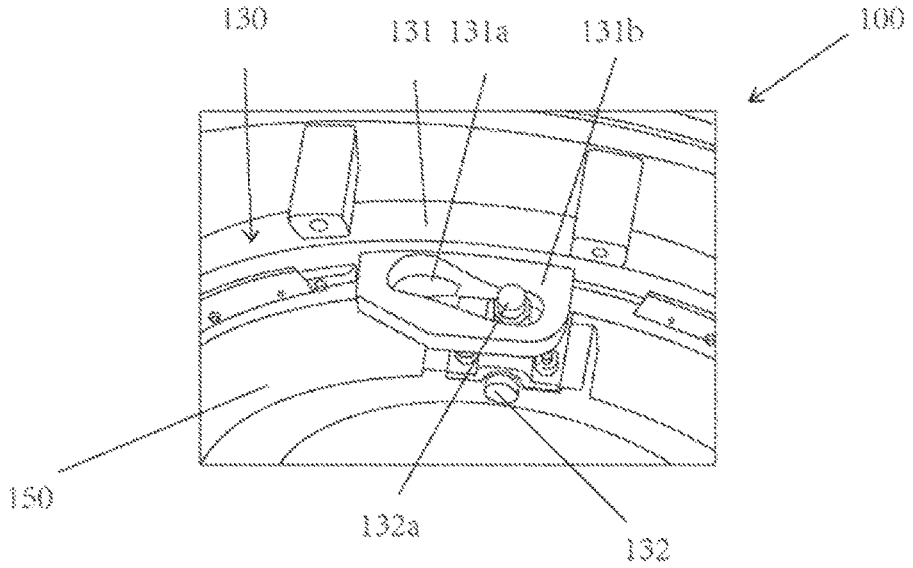
FIG. 5 is a schematic view of connection between an adjustment ring and a guiding rod in one embodiment of a diffuser for a centrifugal compressor according to the present invention.

FIG. 5 is a schematic view of connection between the adjustment ring and the guiding rod in one embodiment of the diffuser for the centrifugal compressor according to the present invention. The adjustment assembly 130 has the adjustment ring 131 and the guiding rod 132 which can be interlocked. It can be appreciated from the figure that upon movement of the drive component, the drive component transmits the torque to the adjustment ring 131 via the transmission assembly, such that the adjustment ring 131 can reciprocate circumferentially with respect to the rear wall 150. During the rotation of the adjustment ring 131, the guiding rod 132 may axially reciprocate with the movement of the adjustment ring under the cooperation between the positioning pin 132*a* and the diagonal groove 131*a*, thereby realizing the adjustment of the width of the diffuser flow passage by driving the spool valve assembly to reciprocate axially.

Specifically, an axially protruding boss 131*b* is provided on the adjustment ring and the diagonal groove 131*a* is provided on the boss 131*b*. Such a configuration is more convenient to arrange the diagonal groove 131*a*, and thus facilitating the cooperation between the adjustment assembly 130 and the spool valve assembly 140. Additionally, such an arrangement does not need to provide a notch on a body of the adjustment ring, thereby better retaining characteristics such as structural strength and the like of the adjustment ring.

More specifically, each diagonal groove 131*a* comprises straight transition sections located at two ends and a sloped guiding section located in the middle. The straight transition sections at two ends are used for realizing a transition stage of the adjustment so as to provide a certain degree of buffering for the motion of the guiding rod, while the sloped guiding section in the middle is practically used for adjusting the diffuser flow passage.

Alternatively, three diagonal grooves 131*a* may be arranged circumferentially and uniformly on the adjustment ring 131, into which three guiding rods 132 are inserted, such that the entire spool valve assembly is driven to reciprocate more uniformly.

Figure 6:
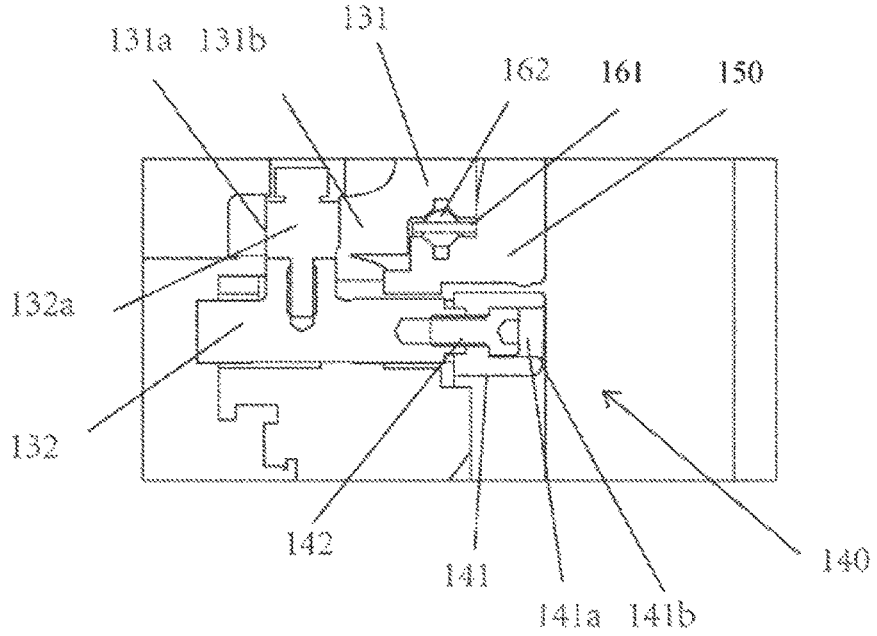
FIG. 6 is a structural schematic view of a spool valve assembly in one embodiment of a diffuser for a centrifugal compressor according to the present invention.
Figure 7:
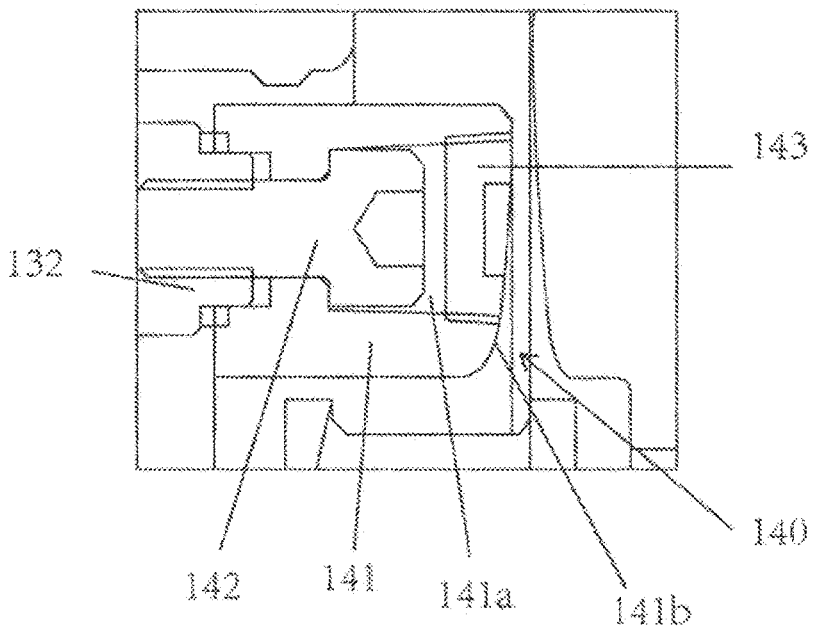
FIG. 7 is a partially enlarged schematic view of a spool valve assembly in one embodiment of a diffuser for a centrifugal compressor according to the present invention.

With reference to FIG. 6 and FIG. 7, there are shown a structural schematic view of the spool valve assembly in one embodiment of the diffuser for the centrifugal compressor according to the present invention.

The spool valve assembly 140 comprises a diffuser ring 141 connected to the guiding rod 132 of the adjustment assembly 130; and the diffuser ring 141 is driven by the guiding rode 132 to pass through the rear wall 150 to reciprocate axially, so as to control a flow area of the flow passage of the diffuser 100.

Specifically, the diffuser ring 141 is provided thereon with a bolt hole 141*a* which is connected with the guiding rod 132 through a bolt 142. Moreover, a bolt hole plug 143 for filling the bolt hole 141*a* is provided at the bolt hole 141*a* on the diffuser ring 141.

Alternatively, an end surface 141*b*, facing the flow passage of the diffuser 100, of the diffuser ring 141 has arc-shaped lines. As one example, with the limitation of the diffuser ring 141, the flow passage of the diffuser is formed as a flow passage tapering from upstream to downstream. As such, a refrigerant air stream flowing at a high speed may undergo a relatively smooth transition at the flow passage, thereby avoiding strong air stream impingement and effectively reducing working noises.

As another embodiment of the present invention, there is further provided a centrifugal compressor which may comprise any one of the embodiments of the diffuser 100 as described above or an improvement or a combination thereof. Therefore, the centrifugal compressor also has corresponding technical effects, and repeated descriptions thereof are thus omitted herein.

Alternatively, in one embodiment of the centrifugal compressor, the diffuser ring 141 is disposed close to a location downstream of an outlet of an impeller of the centrifugal compressor. As such, the adjustment for the flow area of the refrigerant air stream can be realized at the most initial location of the flow passage of the diffuser, and better effects are provided.

Working principles of one embodiment of the centrifugal compressor will be described below in conjunction with the foregoing drawings. Under the condition of partial load operation, a flow rate of the refrigerant is relatively low, at this time, the compressor may easily enter an unstable state, which is referred to as surge. At this time, if a width of a diffuser inlet is reduced, the flow area of the diffuser is reduced, such that the backflow is effectively inhibited, thereby improving the problem of compressor surge and reducing exhaust pressure pulsation and vibration noise. Specifically, the drive component 110 operates at this time, the crank 121 starts to rotate under the driving of the drive component 110 and thereby drives the connecting rod 122 to move upwards, and the upward motion of the connecting rod 122 further drives the adjustment ring 131 to rotate circumferentially and clockwise with respect to the rear wall 150. At this time, with the cooperation of the diagonal groove 131*a* on the adjustment ring 131 and the positioning pin 132*a* on the guide ring 132, the guiding rod is driven to pass through the rear wall 150 and advance axially (along an inward direction of the sheet as shown in FIG. 5), so as to drive the diffuser ring 141 connected therewith to pass through the rear wall 150 and advance axially, thereby a flow area of the diffuser flow passage downstream of the outlet of the impeller is reduced. Moreover, the above-described process may be continuously performed, and thereby stepless adjustment for the flow area of the diffuser flow passage may be realized.

Thereafter, if the machine stops operating or restores to a full load operating state, the flow rate of the refrigerant is normal, and the diffuser flow passage may be fully opened. At this time, the drive component 110 is further started, the crank 121 continues to rotate under the driving of the drive component 110 and drives the connecting rod 122 to move downwards. The downward motion of the connecting rod 122 further drives the adjustment ring 131 to rotate circumferentially and counterclockwise with respect to the rear wall 150. At this time, with the cooperation of the diagonal groove 131*a* on the adjustment ring 131 and the positioning pin 132*a* on the guide ring 132, the guiding rod is driven to pass through the rear wall 150 and retreat axially (along an outward direction of the sheet as shown in FIG. 5), so as to drive the diffuser ring 141 connected therewith to pass through the rear wall 150 and retreat axially, thereby the flow area of the diffuser flow passage downstream of the outlet of the impeller is increased, and finally the flow area is restored to its initial value.

The above examples mainly illustrate a diffuser for a centrifugal compressor and a centrifugal compressor having the same according to the present invention. Although only part of the embodiments of the present invention are described, those skilled in the art should be understood that the present invention may be implemented in many other forms without departing from the spirit and scope of the present invention. Therefore, the presented examples and embodiments are considered illustrative rather than limiting. Various modifications and replacements may be included in the present invention without departing from the spirit and scope of the present invention as defined in the appended claims.

What is claimed is:

1. A diffuser for a centrifugal compressor, characterized in that, the diffuser comprises a drive component, a transmission assembly, an adjustment assembly, a spool valve assembly and a rear wall; wherein the transmission assembly is used for transmitting power produced by the drive component to the adjustment assembly, the adjustment assembly is capable of reciprocating circumferentially with respect to the rear wall and driving the spool valve assembly to reciprocate axially; and wherein a rolling element is provided between the adjustment assembly and the rear wall.

2. The diffuser according to claim 1, characterized in that, the rolling element is a ball bearing which comprises: a ball cage with openings provided circumferentially; balls arranged in the opening; and a baffle for limiting axial movement of the ball cage; wherein the ball cage is arranged circumferentially between an inner side of the adjustment assembly and an outer side of the rear wall.

3. The diffuser according to claim 1, characterized in that, the transmission assembly comprises a crank and a connecting rod; wherein one end of the crank is connected to an output shaft of the drive component and the other end of the crank is connected to the connecting rod, the crank converts rotary motion of the output shaft of the transmission assembly into linear reciprocating motion of the connecting rod; and the connecting rod drives the adjustment assembly to reciprocate circumferentially with respect to the rear wall.

4. The diffuser according to claim 1, characterized in that, the adjustment assembly comprises an interlocking adjustment ring which reciprocates circumferentially with respect to the rear wall under the driving of the transmission assembly, and a guiding rod which drives the spool valve assembly to pass through the rear wall to reciprocate axially upon movement of the adjustment ring.

5. The diffuser according to claim 4, characterized in that, a diagonal groove is provided circumferentially on the adjustment ring, and a positioning pin inserted into the groove is provided on the guiding rod.

6. The diffuser according to claim 5, characterized in that, an axially protruding boss is provided on the adjustment ring and the diagonal groove is provided on the boss.

7. The diffuser according to claim 5, characterized in that, each diagonal groove comprises straight transition sections located at two ends and a sloped guiding section located in the middle.

8. The diffuser according to claim 1, characterized in that, an axially protruding boss and a diagonal groove disposed on the boss are provided on the adjustment assembly; and the spool valve assembly is inserted into the diagonal groove and is capable of reciprocating axially upon movement of the diagonal groove.

9. The diffuser according to claim 1, characterized in that, the spool valve assembly comprises a diffuser ring connected to the adjustment assembly; and the diffuser ring passes through the rear wall to reciprocate axially under the driving of the adjustment assembly, for controlling a flow area of a diffuser flow passage.

10. The diffuser according to claim 9, characterized in that, the diffuser ring and the adjustment assembly are connected through a bolt, and a bolt hole plug for filling a bolt hole is provided at the bolt hole on the diffuser ring.

11. The diffuser according to claim 9, characterized in that, an end surface, facing the diffuser flow passage, of the diffuser ring has arc-shaped lines.

12. The diffuser according to claim 11, characterized in that, the diffuser flow passage is configured, by the diffuser ring, as a flow passage tapering from upstream to downstream.

13. A centrifugal compressor, characterized in that, the centrifugal compressor comprises the diffuser according to claim 1.

14. The centrifugal compressor according to claim 13, characterized in that, the diffuser ring is arranged close to a location downstream of an outlet of an impeller of the centrifugal compressor.

* * * * *